US006435124B1

(12) United States Patent
Williams

(10) Patent No.: US 6,435,124 B1
(45) Date of Patent: Aug. 20, 2002

(54) MOORING AND FLOWLINE SYSTEM

(75) Inventor: Ian Williams, Ipswich (GB)

(73) Assignee: Brovig RDS Limited, Aberdeen (GB)

( * ) Notice: Subject to any disclaimer, the term of this patent is extended or adjusted under 35 U.S.C. 154(b) by 0 days.

(21) Appl. No.: 09/777,606

(22) Filed: Feb. 6, 2001

(30) Foreign Application Priority Data

Feb. 8, 2000 (GB) ..... 0002703

(51) Int. Cl.[7] ..... B63B 21/24
(52) U.S. Cl. ..... 114/293; 114/230.1; 114/230.13
(58) Field of Search ..... 114/293, 230.1, 114/230.12, 230.13; 441/3–5

(56) References Cited

U.S. PATENT DOCUMENTS

| | | | | | |
|---|---|---|---|---|---|
| 3,077,615 | A | * | 2/1963 | Schultz | 9/8 P |
| 3,300,187 | A | * | 1/1967 | Saxe et al. | 9/8 P |
| 3,735,435 | A | * | 5/1973 | Mikulicic et al. | 9/8 P |
| 3,750,723 | A | * | 8/1973 | Schirtzinger | 141/388 |
| 3,840,927 | A | * | 10/1974 | Reid et al. | 9/8 P |
| 3,863,590 | A | * | 2/1975 | Karl et al. | 114/230 |
| 3,922,992 | A | * | 12/1975 | Wilbourn | 114/230 |
| 3,979,785 | A | * | 9/1976 | Flory | 9/8 P |
| 4,065,822 | A | * | 1/1978 | Wilbourn | 114/293 |
| 4,490,121 | A | * | 12/1984 | Coppens et al. | 441/5 |
| 4,509,448 | A | * | 4/1985 | Pease et al. | 114/293 |
| 4,645,467 | A | * | 2/1987 | Pollack | 441/4 |
| 5,044,297 | A | * | 9/1991 | De Baan et al. | 114/293 |
| 5,064,329 | A | | 11/1991 | Brenna | |
| 5,316,509 | A | | 5/1994 | Boatman et al. | |
| 5,564,957 | A | | 10/1996 | Breivik et al. | |
| 5,699,822 | A | * | 12/1997 | Bodhaine | 137/68.15 |
| 5,944,448 | A | | 8/1999 | Williams | |
| 6,126,501 | A | * | 10/2000 | Hooper et al. | 441/5 |
| 6,200,180 | B1 | * | 3/2001 | Hooper | 441/5 |
| 6,279,616 | B1 | * | 8/2001 | Croft et al. | 138/143 |

FOREIGN PATENT DOCUMENTS

| | | |
|---|---|---|
| GB | 2 069 955 A | 9/1981 |
| GB | 2 173 160 A | 10/1986 |
| GB | 2 296 904 A | 7/1996 |

OTHER PUBLICATIONS

VOD's System Simply Cheaper and Easier, *Offshore Journal*, Houston Oil Conference Special, May 6, 1999.

* cited by examiner

*Primary Examiner*—S. Joseph Morano
*Assistant Examiner*—Ajay Vasudeva
(74) *Attorney, Agent, or Firm*—Jenkens & Gilchrist

(57) ABSTRACT

A seabed flowline is connected to a substantially conventional tanker serving as a floating storage facility by a system comprising a three-leg mooring and a flexible riser. The mooring comprises anchors connected by anchor risers to a common node, and a mooring pendant extending from the node to the tanker. The flexible riser comprises a flexible rubber hose extending from the seabed to the tanker, and a single rotational coupling. The hose has a top section secured along part of the mooring pendant, and an intermediate section provided with buoyancy and restrained by a tether to maintain it clear of the anchor risers.

32 Claims, 6 Drawing Sheets

MOORING AND FLOWLINE SYSTEM

CROSS REFERENCE TO RELATED APPLICATIONS

This application claims priority to a prior Great Britain patent application, No. 0002703.7, filed Feb. 8, 2000.

FEDERALLY SPONSORED RESEARCH

Not applicable.

REFERENCE TO MICROFICHE APPENDIX

Not applicable.

FIELD OF THE INVENTION

This invention relates to a mooring and flowline system for use in floating facilities for handling petroleum and petroleum products. The system is particularly, but not exclusively, applicable to the mooring and loading of floating production ship shaped vessels.

BACKGROUND OF THE INVENTION

Production from offshore wells can be exported ashore by subsea pipeline, but this requires a very large capital expenditure. More recently there has been a move to exploiting more marginal fields by the use of a floating production, storage and offtake vessel (FPSO), from which oil is exported periodically by tanker. Commonly, the floating production facility has been provided by conversion of an existing tanker. Such arrangements have worked well, but there is a continuing need for a substantial reduction in installation costs in order to improve the economics of marginal field development and production.

Tanker conversions used hitherto have required extensive conversion. In some cases, a turret mooring is used which includes a rotary oil flowline joint, and this requires major structural work on the tanker in addition to the complex mooring turret. In other cases, a flexible riser to the tanker has been used, but has required large quick disconnect (QDC) valves with a physical size and weight requiring installation outboard of the tanker bow on a specially installed and relatively large structure.

An object of the present invention is to provide an improved mooring and flowline system which is simple and economical to install. It is also an object of the invention to provide a system which enables conventional tankers to be used as floating production, storage and offtake vessels with a minimum of structural alteration.

SUMMARY OF THE INVENTION

Accordingly, the present invention provides a mooring and flowline system comprising: means for mooring a floating production and/or storage vessel to the seabed, and one or more flowlines for connection to one or more producing wells or to a facility; the mooring means comprising at least two anchors in the sea bed, a respective anchor riser extending from each of the anchors, each of the anchor risers having one end secured to its anchor and the other end secured to a common mooring node member, and mooring pendant means extending from the node member for connection, in use, to the vessel; each flowline comprising a seabed flowline extending from the direction of the well or facility into the vicinity of the mooring means, and a flexible riser pipe extending from the seabed flowline to the vessel; and in which each flexible riser pipe is a continuous conduit with a single axial rotational coupling and has part of its length secured alongside the mooring pendant means.

Preferably, there are at least three anchors in an angular array, three anchors at mutual 120° spacings being particularly preferred. The riser pipe is suitably held clear of the anchor risers and node member by providing a portion of the riser pipe to be located through a series of guidance collars, these being attached to the mooring chain pendant to control sideways and rotational movement.

Preferably also, there is no mooring swivel between the anchors and the vessel; the node member may be a plain ring, shackle or plate structure.

The mooring pendant may comprise two parallel chains, one passing over each bow of the vessel; alternatively the mooring pendant may consist of a single chain.

Preferably, the vessel is a tanker.

In a particularly preferred form the invention, which allows a conventional tanker to be utilized as the production vessel with a minimal amount of conversion, the single or twin chains are brought inboard of the tanker to standard chain stoppers or to remotely controlled release stoppers, the riser pipe is brought inboard of the tanker over a chute to have its inboard end lying near the tanker deck, and quick disconnect valve means are located near the tanker deck between said riser pipe and a tank manifold of the tanker.

BRIEF DESCRIPTION OF THE DRAWINGS

An embodiment of the invention will now be described, by way of example, with reference to the drawings, in which.

DESCRIPTION OF EMBODIMENTS OF THE INVENTION

Figure 1:
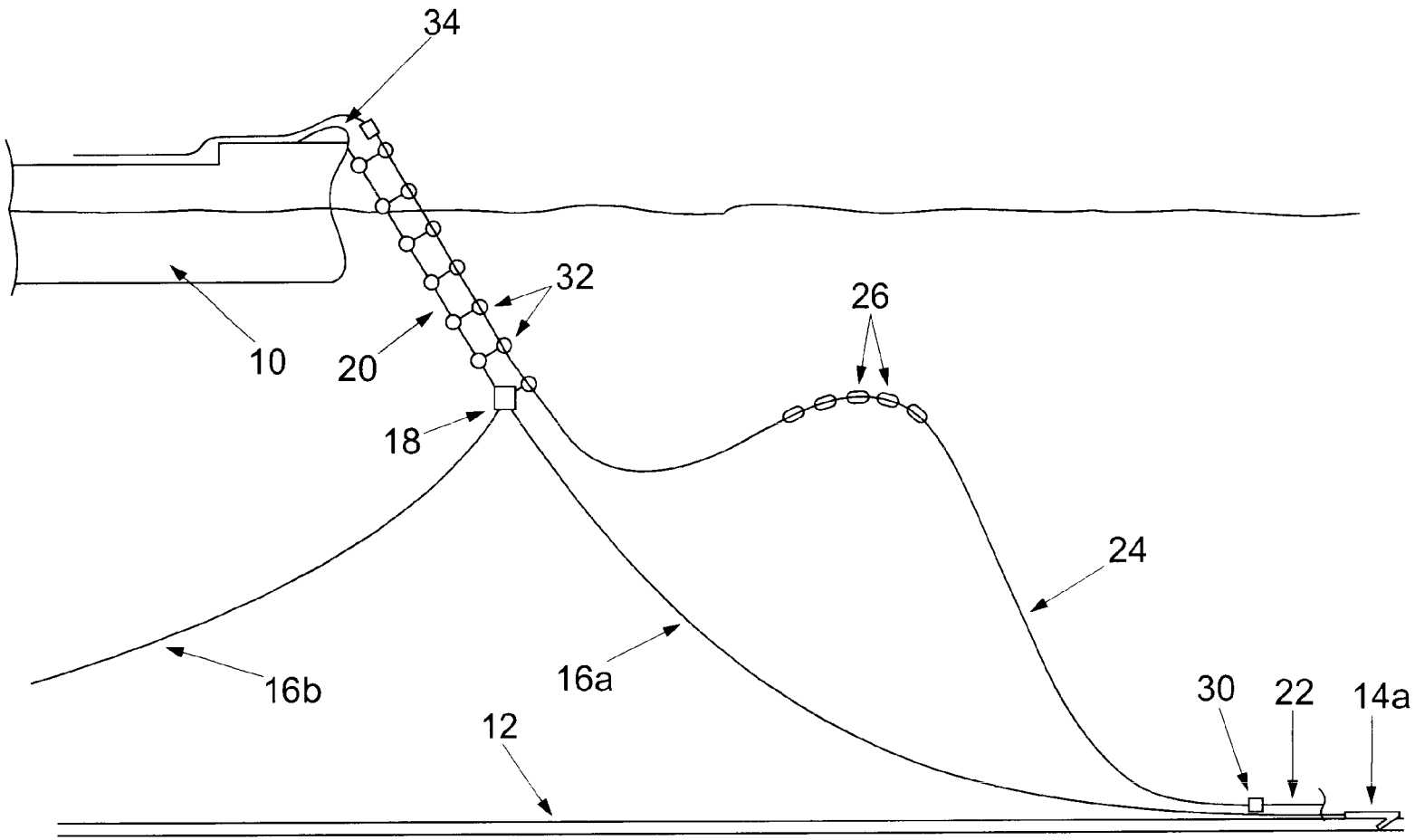
FIG. 1 is a schematic side view of one embodiment of the invention in use with a production tanker.
Figure 2:
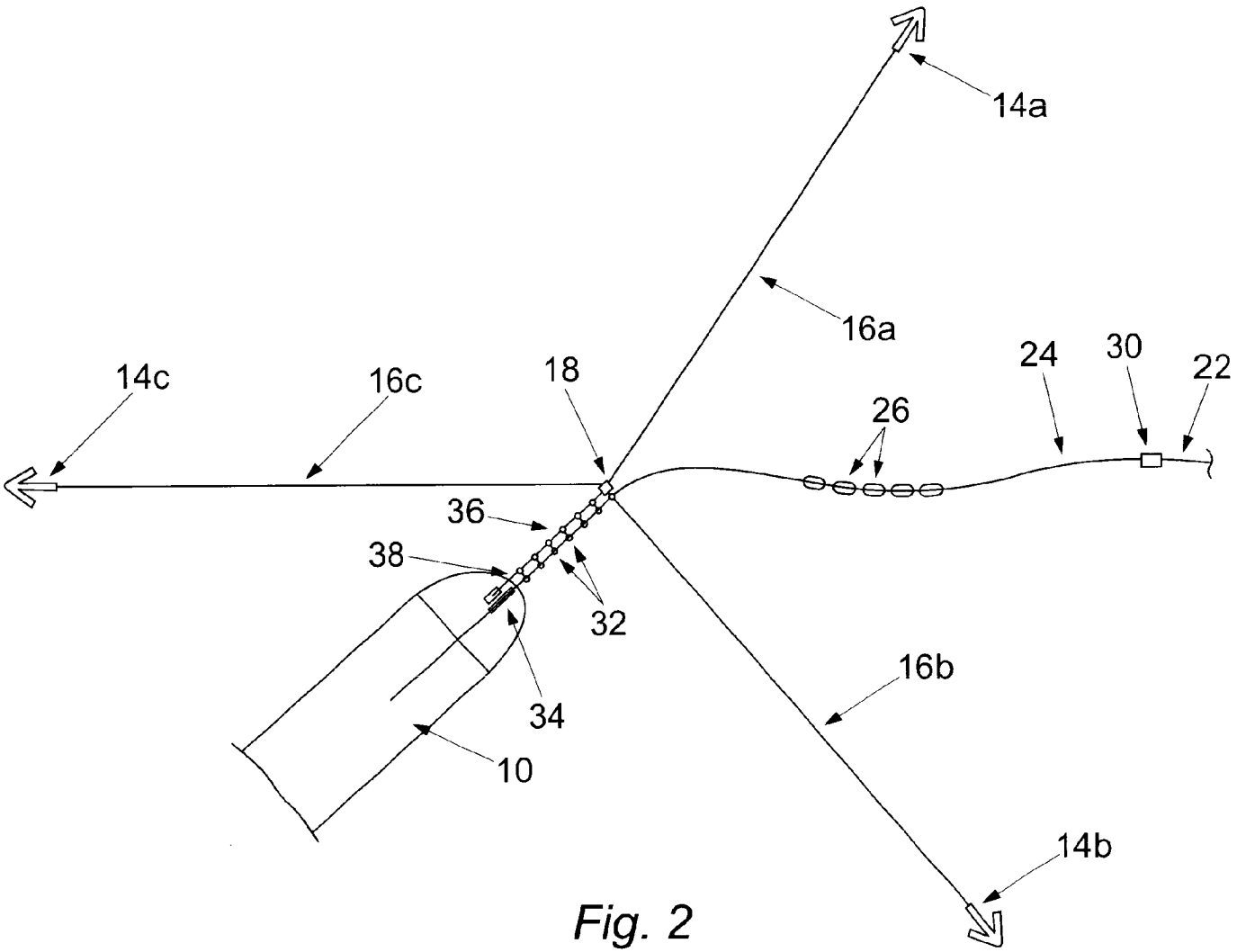
FIG. 2 is a plan view corresponding to FIG. 1.

Referring particularly to FIGS. 1 and 2, a floating production tanker 10 is anchored to the sea bed 12 by means of a three-leg anchor system comprising anchors 14*a*, 14*b*, 14*c* connected by risers 16*a*, 16*b*, 16*c* to a node 18, from which a mooring pendant 20 is secured to the tanker 10. The mooring is in the vicinity of a wellhead (surface or sea bed) (not seen in the drawings) from which oil is transferred via a flowline.

The flowline comprises a seabed portion 22 and a flexible riser pipe 24. The riser 24 has a mid portion which is provided with flotation collars 26 and is restrained by a riser base 30 outboard of the catenary touchdown envelope.

As seen in FIG. 2, the mooring is set such that a 120° angle may be presented towards the sea bed flowline 22 direction. This geometry, together with the flotation of the collars 26 and the restraint by the riser base 30 allows a number of flowlines to be accommodated from different directions, maintaining each riser pipe 24 clear of conflict with each other and the mooring node 18.

The upper part of the riser pipe 24 is secured along the mooring pendant 20 by specifically spaced multi collars 32 that are each rigidly connected to an individual chain link.

The riser pipe 24 is taken aboard the tanker 10 via a chute assembly indicated at 34.

The anchors 14 may be any suitable form of conventional mooring anchor. Each of the anchor risers 16 has at least some of its on-bottom length constituted by chain. For water depths up to about 75 meters, the chain can be continuous to the node 18.

In greater water depths up to about 350 meters, it is preferred to have the on-bottom section of chain but the catenary section of wire rope; beyond about 350 meters, the catenary section may be of synthetic rope. The use of rope has several advantages. Principally, it reduces the weight which has to be lifted when the tanker is connecting to the system, as is discussed more fully below. It also makes the departure angle of the riser 16 from the node 18 nearer the horizontal, which increases the horizontal stability of the system, and simplifies stowage on the vessel used to deploy the system. Where rope is used for the catenary section, it is desirable to have the final 30 meters or so nearest the node 18 of chain, to reduce the risk of kinking of the rope.

The node 18 may take any suitable form which connects together the three risers 16 and the pendant 20 with adequate mechanical strength. A suitably sized master ring may be used, or a triangular plate arrangement, together with conventional shackles. No swivel is incorporated in the node 18. A fitting on the node 18 may be used as the lowest of the multi collars 26.

In some circumstances there may be an advantage in reducing the weight of the node and the catenary sections, and to this end, buoyancy (not shown) may be incorporated in the node 18 or in the anchor risers 16 adjacent to the node 18.

In a typical installation, the tanker 10 is a segregated ballast tanker of 600,000 to 750,000 bbl capacity and the mooring is designed to hold the node 18 at a depth of 30 meters, and thus up to about 15 meters beneath the tanker hull. In these circumstances, the mooring pendant 20 will require to be of the order of 40 or 50 meters in length.

The preferred form for the mooring pendant 20 comprises a single, large-size chain 36 extending from the node 18 and connected to a single chafe chain 38. For the same order of size of the tanker 10, it is suitable to have the chain up to 120 mm size, which will fit many standard chain stoppers. This arrangement simplifies the node design and minimizes modification to the tanker.

Figure 4A:
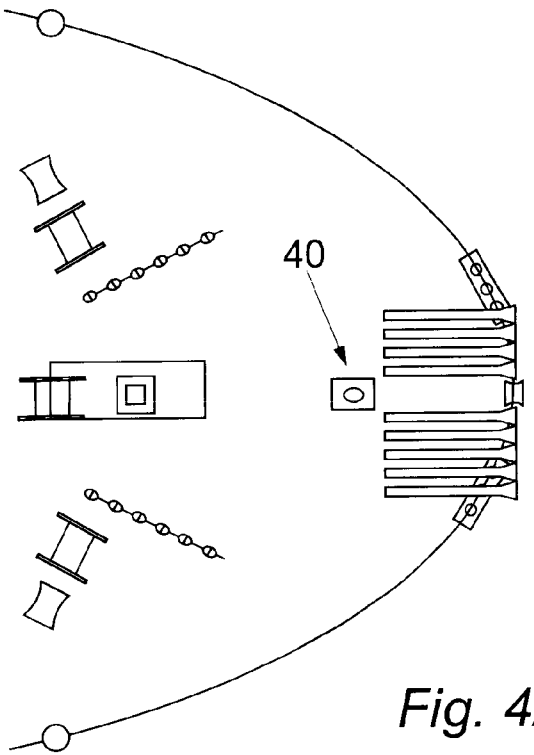
FIG. 4A is a schematic plan view of an arrangement with multiple risers.
Figure 4:
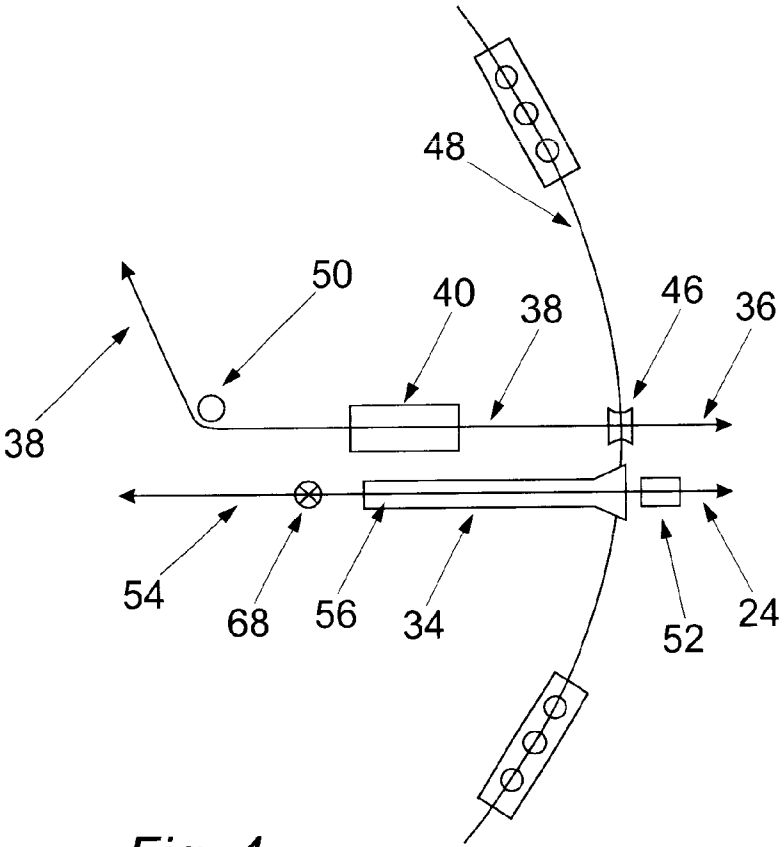
FIG. 4 is a schematic plan view of a tanker bow illustrating a suitable arrangement for use in the present invention with a single riser.
Figure 5:
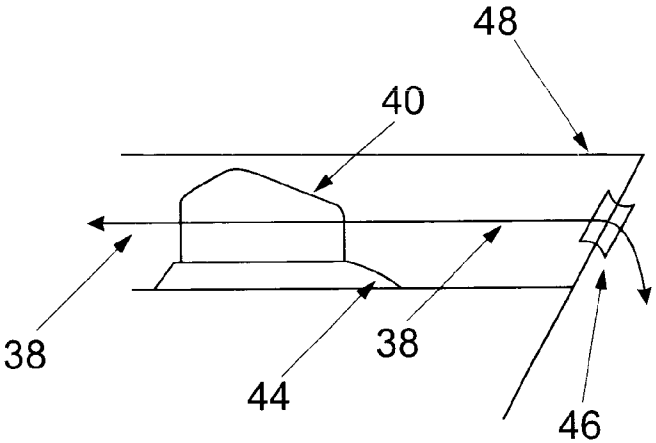
FIG. 5 is a side view corresponding to FIG. 4.

Referring to FIGS. 4 and 5, there is shown a suitable tanker bow installation which requires a minimum of modification from standard shipping practice. The chain 38 is held by a standard chain stopper 40 that may be raised above the foc'sle deck 42 on a seating 44. The incoming chain 38 passes through a fairlead 46 in the bow bulwark 48 aligned with the chain stopper 40, and the inboard end of the chain is passed to a winch or windlass, via (if necessary) a pedestal fairlead 50.

Figure 6:
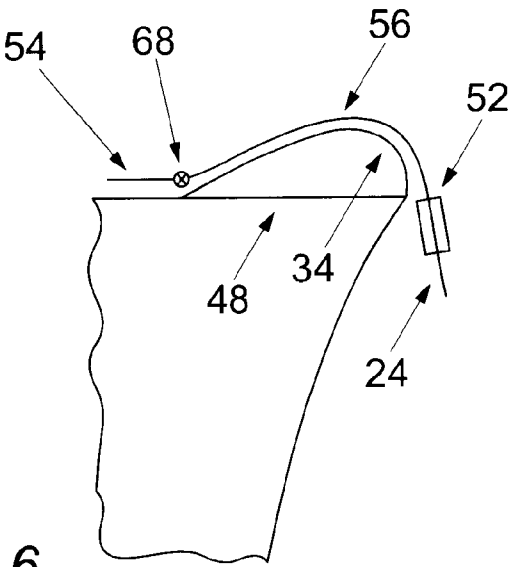
FIG. 6 is a side view of a chute seen in FIG. 5.

As will be seen from FIGS. 5 and 6, the chute 34 is a simple structure providing an arcuate guide on two axes for the riser pipe 24. It is not necessary to have any guidance for the riser 24 below bulwark level, since the riser will be spaced away from the remainder of the vessel's hull by the considerable flare of the foc'sle bulwarks in relation to the lower part of the hull. On some tankers, a short cantilever may be necessary to provide vertical clearance from a bulbous bow.

Figure 7:
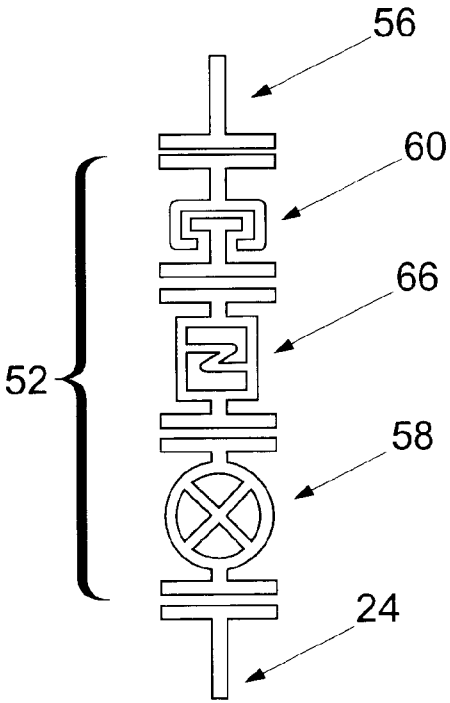
FIG. 7 illustrates in more detail part of the oil line seen in FIG. 5.

FIG. 5 also indicates the position on the foc'sle deck level of valve gear generally designated at 52. The valve gear 52 is shown in more detail in FIG. 7, in which it will be seen that the riser pipe 24 is connected to a deck line 54 via a manually operated ball valve 58, a breakaway cum emergency release unit 66, a rotational coupling 60, and a short section of flexible pipe 56. The breakaway cum emergency release unit 66 is suitably a Gall-Thomson coupling which has bolts which shear at a predetermined axial load, the chute 34 and the short section of flexible pipe 56 ensuring that the load on the coupling is always axial. The breakaway cum emergency release unit 66 also seals the pipe both sides of the unit as the unit breaks apart. The manually operated ball valve 58 would be used to close the connection in normal disconnection routines. The hydraulically or gas pressure activated release system within the breakaway cum emergency release unit 66 can be operated remotely, for example, from the bridge of the vessel, where it is decided to make an emergency disconnection of the tanker. The emergency shutdown valve 68 is included to provide shutdown of flow without disconnection and would normally be part of the tanker's equipment, even if not located close to the release system.

The deck line 54 is most conveniently connected with the vessel tankage via a process plant or the midships manifold, subject to the use of the system for production or storage, respectively.

The deck line 54 can be provided in the form of steel tubing secured to the deck, or in the case of low pressure usage, as a further length of flowline.

The riser pipe 24 must be a flexible hose with sufficient dynamic properties to accept movement of the ship's bow and movement of the touchdown point at the bottom of the catenary. Both unbonded and bonded pipes of a wide variety of sizes and specifications are suitable.

FIG. 4A shows a modified arrangement for use with eight riser pipes (not shown). This makes use of eight chutes 34 arranged in parallel on the tanker bow. Each riser pipe is a flexible pipe as before, and each is provided with its own valve assembly 52 as in FIG. 4.

It will be appreciated from the foregoing description that the arrangement in operation will cause the riser pipe to helix around the pendant chain. There will, therefore, be a restriction on the number of turns the vessel can make, since turning fill circle will effectively twist the fluid riser and the chain around each other. Contrary to previous practice, the present inventors believe and can demonstrate that the limit of this helixing is not a practicable restriction in a floating production situation. It is believed that the weather patterns actually found in practice may make a vessel do complete turns; however, there are more than sufficient lighter weather periods when the tanker can take a turn, back out either using its own engines and rudder, or being pulled round by a tug.

Figure 8:
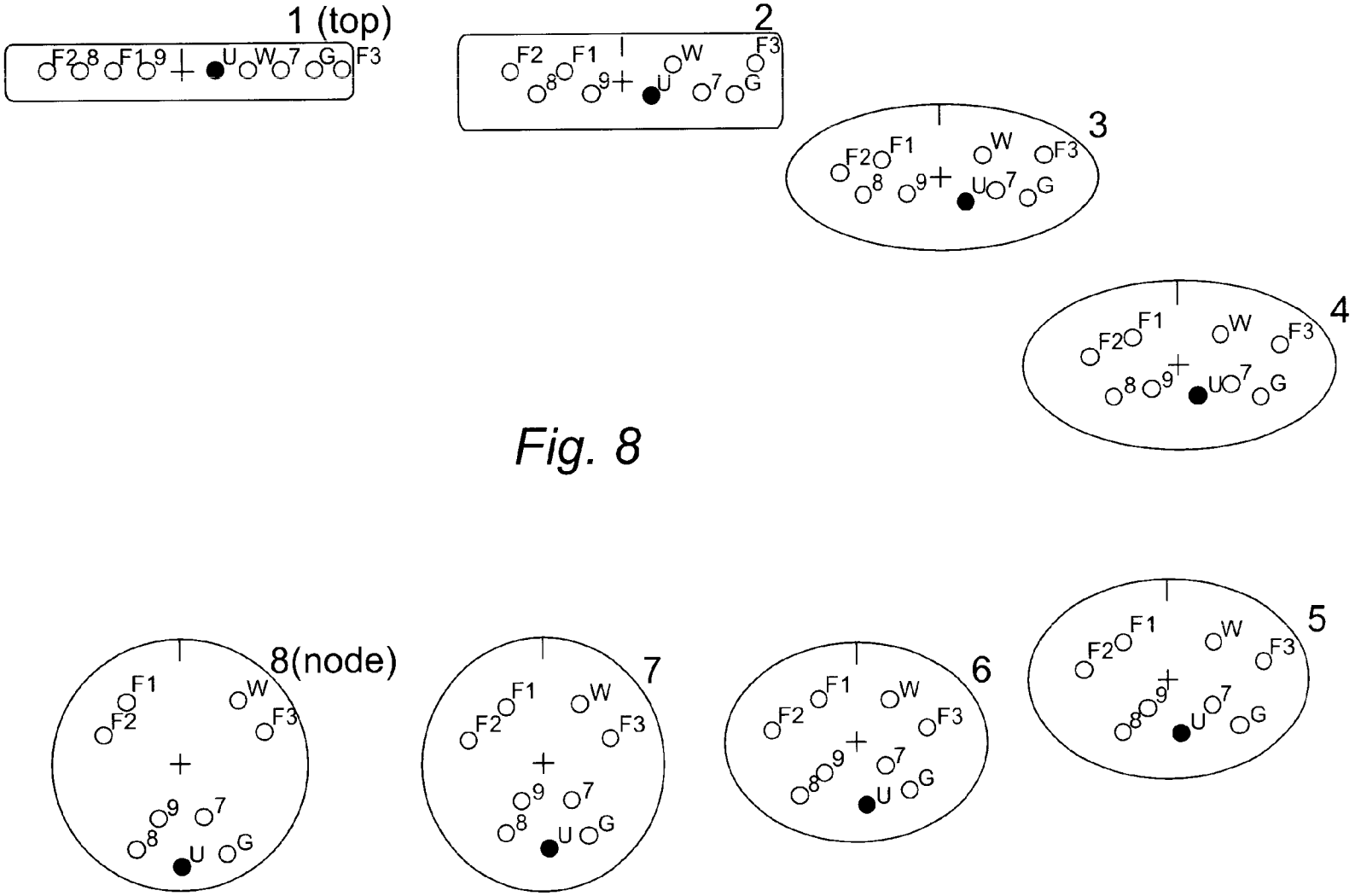
FIG. 8 illustrates part of a multi-riser system in more detail.

FIG. 8 illustrates more detail of an eight riser system as in FIG. 4A, and shows the disposition of the risers passing through nine collars around the mooring pendant chain whose location is marked by a cross. This shows how risers approaching the node from different directions are brought into a parallel array at the vessel's bow.

Because it uses standard anchors and anchor cable, a normal anchor handling tug supply vessel can install the system. Initially each anchor would be laid using DGPS to a 10 meter tolerance. This has been achieved in depths in excess of 500 meters so is not anticipated a problem in any depth.

Each anchor is laid in turn, the cables run back to a common point; each cable as it is laid is buoyed off on a pendant wire. Insurance tensioning of the anchors can be done using the bollard pull of suitable vessels or with the inclusion in the system of a standard chain tensioned. One of the mooring legs includes a standard seabed chain stopper for correct pre-tensioning of the system. When all three have been laid, the anchor handler recovers all three cables over the stern roller.

Figure 3:
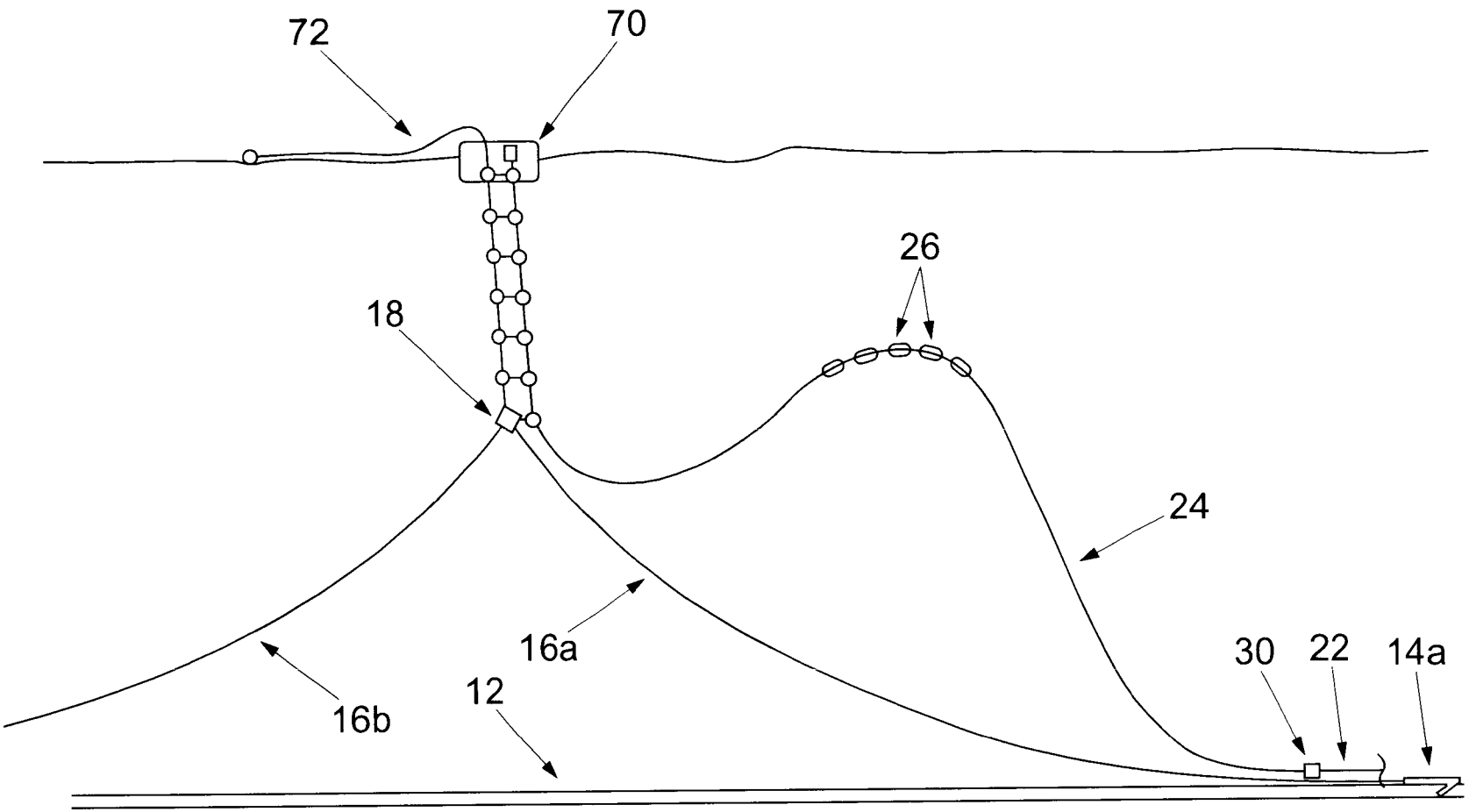
FIG. 3 is a view similar to FIG. 1 but showing the system out of use with the tanker removed.

The node point is assembled and deployed over the side with the chafe chain and appropriate buoyancy 70 to maintain proper riser pipe catenary shapes, for example as illustrated in FIG. 3. Correct pre-tensioning for the previously carried out design parameters is then achieved by use of the seabed chain stopper. A pick-up rope 72 is attached to the upper end of the chain pendant.

When the tanker is coming onto location, the pick-up rope 72 is recovered, either by the tanker itself or by a support vessel and fired across to the tanker using a compressed air rocket gun. The tanker pulls on the pick-up rope and starts to heave in the chafe chain, securing them in the chain stoppers. The winches of a typical tanker can be supplemented by a block and tackle or a temporary winch to achieve sufficient pull for this application, which may require a pull of up to 90 tonnes.

The invention thus provides a mooring and flowline system which can handle one or more flowlines making use of a minimally converted tanker and relatively small, standard components. In particular, the present invention may use individual hose swivels each typically 600 mm long, weighing 120 kg and costing about GBP 20,000, made as standard components by manufacturers such as Woodfield. In contrast, prior art systems require the use of a multi-path (toroidal) flowline swivel which can be up to 10 m high, weigh several tens of tons, and cost GBP 3–4 million.

What is claimed is:

1. A mooring and flowline system comprising:

means for mooring at least one of a floating production vessel and storage vessel to the seabed, at least one flowline for connection to at least one producing well or to a facility;

the means for mooring a vessel to the seabed comprising at least two anchors in the sea bed, a respective anchor riser extending from each of the anchors, each of the anchor risers having one end secured to its anchor and the other end secured to a common mooring node member, and mooring pendant means extending from the node member, the mooring pendant means having an upper end for connection, in use, to the vessel;

each flowline comprising a seabed flowline extending from the direction of the well or facility into the vicinity of the means for mooring a vessel to the seabed, and a flexible riser pipe extending from the seabed flowline towards the water surface; and in which the flexible riser pipe is a continuous conduit with a single axial rotational coupling and has part of its length secured alongside the mooring pendant means so that, in use, the flexible riser pipe is capable of helixing around the mooring pendant means in response to turning of the vessel.

2. A system according to claim 1, in which there are at least three anchors in an angular array.

3. A system according to claim 2, in which there are three anchors at mutual 120° spacings.

4. A system according to claim 1, in which the riser pipe is of bonded or unbonded rubber construction.

5. A system according to claim 1, in which a portion of the riser pipe is provided with flotation means.

6. A system according to claim 1, in which there is no swivel between the anchors and the upper end of the mooring pendant means.

7. A system according to claim 1, in which the node member comprises a plate structure or one or more plain rings or shackles.

8. The combination of a mooring and flowline system in accordance with claim 1, and a vessel;

the vessel including stopper means releasably securing the mooring pendant means, fairlead means-receiving the mooring pendant means from outboard and guiding it to said stopper means, a petroleum conduit including a valve, a swivel and a quick connect/disconnect assembly, and a chute for receiving and guiding the petroleum conduit;

the flexible riser, in use, being in flow connection with said quick connect/disconnect assembly and being secured to the mooring pendant means outboard of said fairlead means.

9. A system according to claim 8, in which the mooring pendant means comprises one or two parallel chains, passing on to a bow of the vessel.

10. A system according to claim 8, in which the vessel is a tanker.

11. A system according to claim 10, in which the mooring pendant means are brought inboard of the tanker to standard chain stoppers or to remotely controlled release stoppers.

12. A system according to claim 11, in which the riser pipe is connected to a valve, swivel and quick connect/disconnect assembly, and is then brought inboard of the tanker over a chute to have its inboard end lying near to a tanker deck.

13. A system according to claim 12, in which said valve, swivel and quick connect/disconnect assembly includes a self-sealing breakaway coupling.

14. The combination of claim 8, said vessel being a tanker ship with said chute and valve means positioned on a forecastle of the ship, and in which the mooring pendant means comprises a single chain pendant, the fairlead means comprises a single fairlead for the chain pendant and said stopper means comprises a standard chain stopper.

15. A system according to claim 1, in which there are a plurality of flowlines.

16. A system according to claim 1 comprising at least one collar having a first aperture through which the means for mooring a vessel to the seabed extends, and at least one further aperture through which the at least one flowline extends.

17. A mooring and flowline system comprising:

an apparatus for mooring at least one of a floating production vessel and storage vessel to the seabed, at least one flowline for connection to at least one producing well or to a facility;

the apparatus for mooring a vessel to the seabed comprising at least two anchors in the sea bed, a respective anchor riser extending from each of the anchors, each of the anchor risers having one end secured to its anchor and the other end secured to a common mooring node member, and a mooring pendant mechanism extending from the node member, the mooring pendant mechanism having an upper end for connection, in use, to the vessel;

each flowline comprising a seabed flowline extending from the direction of the well or facility into the vicinity of the apparatus for mooring a vessel to the seabed, and a flexible riser pipe extending from the seabed flowline towards the water surface; and in which the flexible riser pipe is a continuous conduit with a single axial rotational coupling and has part of its length secured alongside the mooring pendant mechanism so that, in use, the flexible riser pipe is capable of helixing around the mooring pendant mechanism in response to turning of the vessel.

18. A system according to claim 17, in which there are at least three anchors in an angular array.

19. A system according to claim 18, in which there are three anchors at mutual 120° spacings.

20. A system according to claim 17, in which the riser pipe is of bonded or unbonded rubber construction.

21. A system according to claim 17, in which a portion of the riser pipe is provided with a flotation mechanism.

22. A system according to claim 17, in which there is no swivel between the anchors and the upper end of the mooring pendant mechanism.

23. A system according to claim 17, in which the node member comprises a plate structure or one or more plain rings or shackles.

24. The combination of a mooring and flowline system in accordance with claim 17, and a vessel;

the vessel including a stopper mechanism releasably securing the mooring pendant mechanism, a fairlead apparatus receiving the mooring pendant mechanism from outboard and guiding it to said stopper mechanism, a petroleum conduit including a valve, a swivel and a quick connect/disconnect assembly, and a chute for receiving and guiding the petroleum conduit;

the flexible riser, in use, being in flow connection with said quick connect/disconnect assembly and being secured to the mooring pendant mechanism outboard of said fairlead apparatus.

25. A system according to claim 24, in which the mooring pendant mechanism comprises one or two parallel chains, passing on to a bow of the vessel.

26. A system according to claim 24, in which the vessel is a tanker.

27. A system according to claim 26, in which the mooring pendant mechanism is brought inboard of the tanker to standard chain stoppers or to remotely controlled release stoppers.

28. A system according to claim 27, in which the riser pipe is connected to a valve, swivel and quick connect/disconnect assembly, and is then brought inboard of the tanker over a chute to have its inboard end lying near to a tanker deck.

29. A system according to claim 28, in which said valve, swivel and quick connect/disconnect assembly includes a self-sealing breakaway coupling.

30. The combination of claim 24, said vessel being a tanker ship with said chute and valve positioned on a forecastle of the ship, and in which the mooring pendant mechanism comprises a single chain pendant, the fairlead apparatus comprises a single fairlead for the chain pendant and said stopper mechanism comprises a standard chain stopper.

31. A system according to claim 17, in which there are a plurality of flowlines.

32. A system according to claim 17 comprising at least one collar having a first aperture through which the apparatus for mooring a vessel to the seabed extends, and at least one further aperture through which the at least one flowline extends.

* * * * *